US008681193B2

(12) United States Patent
Zhu

(10) Patent No.: US 8,681,193 B2
(45) Date of Patent: Mar. 25, 2014

(54) STEREOSCOPIC DISPLAY AND DRIVING METHOD THEREOF

(75) Inventor: Xiujian Zhu, Beijing (CN)

(73) Assignees: Boe Technology Group Co., Ltd., Beijing (CN); Hefei Xinsheng Optoelectronics Technology Co., Ltd., Hefei, Anhui Province (CN)

( * ) Notice: Subject to any disclaimer, the term of this patent is extended or adjusted under 35 U.S.C. 154(b) by 255 days.

(21) Appl. No.: 13/228,057

(22) Filed: Sep. 8, 2011

(65) Prior Publication Data

US 2012/0062624 A1 Mar. 15, 2012

(30) Foreign Application Priority Data

Sep. 9, 2010 (CN) ..... 2010 1 0278167

(51) Int. Cl.
*G09G 5/10* (2006.01)

(52) U.S. Cl.
USPC ..... 345/691; 348/43; 348/51

(58) Field of Classification Search
USPC ..... 345/427, 1.1–9; 348/42–60
See application file for complete search history.

(56) References Cited

U.S. PATENT DOCUMENTS

| | | | | |
|---|---|---|---|---|
| 7,417,664 | B2 * | 8/2008 | Tomita | 348/43 |
| 2004/0233275 | A1 * | 11/2004 | Tomita | 348/51 |
| 2006/0203085 | A1 * | 9/2006 | Tomita | 348/51 |
| 2011/0074933 | A1 * | 3/2011 | Held et al. | 348/51 |

FOREIGN PATENT DOCUMENTS

CN 1749808 A 3/2006

OTHER PUBLICATIONS

First Chinese Office Action dated Dec. 18, 2012; Appln. No. 201010278167.6.
Second Chinese Office Office Action dated Aug. 26, 2013, Appln. No. 201010278167.6.

* cited by examiner

*Primary Examiner* — Alexander Eisen
*Assistant Examiner* — Sanjiv D Patel
(74) *Attorney, Agent, or Firm* — Ladas & Parry LLP

(57) ABSTRACT

A driving method for stereoscopic display is provided, and the method comprises: obtaining a distance between a viewer and the stereoscopic display; obtaining an offset amount for sub-pixels of different colors displaying the same image point for the different eyes based on the above distance; obtaining a transformed transmission sequence of 2D image sub-pixel signals based on the offset amount, in which the sub-pixels of different colors for displaying the same image point for the different eyes are offset by the offset amount on the stereoscopic display; and outputting the 2D image sub-pixel signals according to the transformed transmission sequence so as to display sub-images of different colors for the different eyes.

13 Claims, 1 Drawing Sheet

STEREOSCOPIC DISPLAY AND DRIVING METHOD THEREOF

BACKGROUND

Embodiments of the disclosed technology relate to a driving method for stereoscopic display and a stereoscopic display.

Most of the current three dimensional (3D) stereoscopic displays operate by displaying different images including a left-eye view image and a right-eye view image which in turn form a left-and-right eye composite view, so that a 3D image with a stereoscopic effect appears before a viewer wearing a set of color filter glasses. The color filter glasses worn by the viewer may prevent the left-eye view from passing through the right-eye lens and the right-eye view from passing through the left-eye lens. Therefore, the left eye of the viewer only sees the left-eye view image, and the right eye only sees the right-eye view image, so as to form a 3D image with a stereoscopic effect. The color filter glasses comprise the kinds of red/blue glasses, red/cyan glasses and red/green glasses. Hereinafter, a set of red/blue glasses (one lens is blue and the other is red) is taken as an example to explain the displaying principle of the color filter glasses in detail. The left-eye view image and the right-eye view image with binocular parallax are "dyed" by red light and blue light. Because the lenses of the red/blue glasses filter out the image of the same color as that of this corresponding lens, the blue image can only be seen through the red lens and the red image is filtered; and the red image can only be seen through the blue lens and the blue image is filtered. That is to say, the two eyes of the viewer can see a corresponding image in the left-and-right composite view, respectively, which leads to a stereoscopic visual effect.

The left-eye view image and the right-eye view image need to be shoot separately and then processed in order to generate a left-and-right-eye composite view, which is suitable for a viewer wearing a set of color filter glasses to view. This process makes the cost to process the two dimensional images increased. In addition, an optimal viewing distance or an optimal viewing range corresponds to the formed left-and-right-eye composite view, and the best 3D image with stereoscopic effect can be seen only if the viewer is at the optimal viewing distance or within the optimal viewing range, which impairs the flexibility and convenience.

SUMMARY

An embodiment of the disclosed technology provides a driving method for stereoscopic display, comprising: obtaining a distance between a viewer and the stereoscopic display; obtaining an offset amount for sub-pixels of different colors displaying the same image point for the different eyes based on the above distance; obtaining a transformed transmission sequence of 2D image sub-pixel signals based on the offset amount, in which the sub-pixels of different colors for displaying the same image point for the different eyes are offset by the offset amount on the stereoscopic display; and outputting the 2D image sub-pixel signals according to the transformed transmission sequence so as to display sub-images of different colors for the different eyes.

Another embodiment of the disclosed technology provides a stereoscopic display, comprising: a driving circuit; a display screen; and a timing controller, connected with the driving circuit, and adapted to obtain a distance between the stereoscopic display and a viewer, an offset amount of the sub-pixels of different colors for displaying an image point for the different eyes based on the distance, and then a transformed transmission sequence of the 2D image sub-pixel signal corresponding to the above offset amount, so that the sub-pixels of different colors displaying the image point for the different eyes are offset by the offset amount on the display screen, and to output the 2D image sub-pixel signals according to the transformed transmission sequence into the driving circuit to display the sub-images of different colors for the different eyes.

Further another embodiment of the disclosed technology provides a driving method for a stereoscopic display, comprising: obtaining a distance between a viewer and the stereoscopic display; obtaining an offset amount for sub-images of different colors displaying the same image for the different eyes based on the above distance; obtaining a transformed transmission sequence of 2D image sub-pixel signals based on the offset amount, in which the sub-images of different colors for the different eyes are offset by the offset amount on the stereoscopic display; and outputting the 2D image sub-pixel signals according to the transformed transmission sequence so as to display sub-images of different colors for the different eyes.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from the following detailed description.

BRIEF DESCRIPTION OF THE DRAWINGS

The disclosed technology will become more fully understood from the detailed description given hereinafter and the accompanying drawings which are given by way of illustration only, and thus are not limitative of the disclosed technology and wherein.

DETAILED DESCRIPTION

Figure 1:
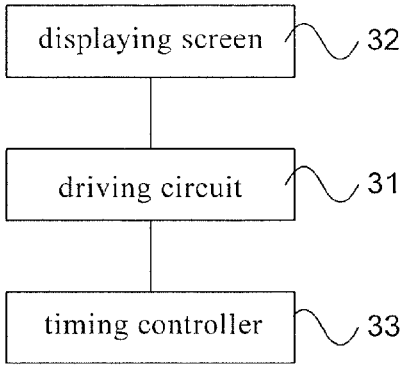
FIG. 1 is a schematic view showing a structure of a liquid crystal display according to an embodiment of the disclosed technology.

Embodiments of the disclosed technology now will be described more clearly and fully hereinafter with reference to the accompanying drawings, in which the embodiments of the disclosed technology are shown. Apparently, only some embodiments of the disclosed technology, but not all of embodiments, are set forth here, and the disclosed technology may be embodied in other forms. All of other embodiments made by those skilled in the art based on embodiments disclosed herein without mental work fall within the scope of the disclosed technology.

A first embodiment of the disclosed technology provides a driving method for a liquid crystal display (LCD), which comprises the following steps.

Step 101, obtaining the distance between a viewer and the liquid crystal display.

Specifically, obtaining the distance between the viewer and the liquid crystal display can be performed in the following ways but not limited thereto:

A), obtaining the distance input by the viewer; and

B), obtaining the distance by using a distance sensor disposed in the liquid crystal display.

Step 102, obtaining an offset amount based on the above obtained distance. As for the liquid crystal display or other displays, one pixel may comprise several sub-pixels of different colors. The lights emitted from the sub-pixels of different colors within one pixel are synthesized or mixed to from the image point (pixel) to be displayed. As far as the embodiment of the disclosed technology concerned, the sub-images displayed by the sub-pixels of different colors (entering into different eyes of the viewer through the color filter glasses) are offset or displaced by a distance, so that the stereoscopic view displaying can be performed. That is to say, the signals that are originally distributed to the sub-pixels within the same pixel during 2D displaying are offset from each other by a certain pixel columns according to their colors, and the offset pixel column number is the offset amount in the embodiment of the disclosed technology.

Specifically, in this step, the offset amount can be obtained based on the above mentioned distance in the following ways but not limited thereto:

A), obtaining the offset amount corresponding to the distance according to a predetermined empirical equation.

Specifically, the offset amount can be calculated with the following empirical equation:

$$a=[L*d/c],$$

where "a" is an offset amount and is an integer; the symbol "[ ]" means round function; "L" is a distance, "c" is a pixel pitch in a liquid crystal display, "d" is ranging from 0.003~0.02. For example, "d" is 0.01.

B), obtaining the offset amount based on the distance according to a predetermined correspondence between the distance and the offset amount for the liquid crystal display.

Specifically, the correspondence between the distance and the offset amount can be predetermined according to the types of respective liquid crystal display, as shown in Table 1.

TABLE 1

Correspondence between the distance and the offset amount (liquid crystal display with a pixel pitch of c1)

| Distance | Offset amount |
|---|---|
| L1 | a1 |
| L2 | a2 |
| L3 | a3 |
| L4 | a4 |
| . . . | . . . |

Step 103, obtaining a transformed transmission sequence of a 2D image sub-pixel signals based on the offset amount, so that the sub-pixels for displaying the sub-images for the different eyes are offset by the offset amount.

Step 104, according to the above mentioned transformed transmission sequence, the 2D image sub-pixel signals are output so as to drive the liquid crystal display to display a 3D image with a stereoscopic effect before a viewer wearing a set of color filter glasses.

In the embodiment, the offset amount is obtained based on the distance between the viewer and the liquid crystal display which is input by the viewer. Further, the transformed transmission sequence of the 2D image sub-pixel signals corresponding to the above offset amount is obtained. By outputting the 2D image sub-pixel signals according to the above transformed transmission sequence, the liquid crystal display is driven to display a 3D image with a stereoscopic effect before the viewer wearing a set of color filter glasses. The method according to the embodiment of the disclosed technology can reduce the processing cost on the 2D image and enhance the flexibility for viewing.

A driving method for a liquid crystal display according to a second embodiment of the disclosed technology comprises the following steps.

Step 201, obtaining a distance between the viewer and the liquid crystal display by a timing controller.

Specifically, the obtaining the distance between the viewer and the liquid crystal display may be performed in the ways as described in the first embodiment.

Further, before or after this step, the timing controller can obtain the original transmission sequence of the 2D image sub-pixel signals. Herein, it is assumed that the resolution of the liquid crystal display is m*n. The original transmission sequence of the 2D image sub-pixel signals may be: sequentially transferring the pixel signals from the first row to the $n_{th}$ row to the pixels in the first row to the $n_{th}$ row of the display (e.g., sequential scanning), and when the pixel signals for each row are transferred, transferring the red sub-pixel signal (R), the green sub-pixel signal (G) and the blue sub-pixel signal (B) for each column from the first column to the $m_{th}$ column to the red sub-pixel, the green sub-pixel, and the blue sub-pixel of each pixel in first column to the $m_{th}$ column in each row, as shown in Table 2.

TABLE 2

Original transmission sequence of the sub-pixel signals in each row

| | | | | | | | | | | | | |
|---|---|---|---|---|---|---|---|---|---|---|---|---|
| 1R | 2R | 3R | . . . | . . . | aR | (a + 1)R | (a + 2)R | . . . | . . . | (m − 2)R | (m − 1)R | mR |
| 1G | 2G | 3G | . . . | . . . | aG | (a + 1)G | (a + 2)G | . . . | . . . | (m − 2)G | (m − 1)G | mG |
| 1B | 2B | 3B | . . . | . . . | aB | (a + 1)B | (a + 2)B | . . . | . . . | (m − 2)B | (m − 1)B | mB |

The Table 2 corresponds to one row of pixels of the display, each column corresponds to one pixel of the display, and each unit corresponds to a sub-pixel of one color (e.g., red, green or blue). When the display works to display an image with the original transmission sequence of the 2D image sub-pixel signals, the red sub-pixels of the display form a red sub-image of the image, and the green sub-pixels and blue sub-pixels of the display form a cyan sub-image of the image; the red sub-image and the cyan sub-image do not offset from each other. The viewer receives the red sub-image and the cyan sub-image and regenerate the image to be displayed in his/her brain.

Step 202, obtaining an offset amount by the timing controller with a empirical equation a=[L*d/c], where "a" is an offset amount and is an integer; the symbol "[ ]" means round function; "L" is a distance, "c" is a pixel pitch in a liquid crystal display; "d" is ranging from 0.003~0.02. For example, d is 0.01.

Step 203, obtaining a transformed transmission sequence of the 2D image sub-pixel signals based on the offset amount by the timing controller.

Based on the obtained original transmission sequence of the 2D image sub-pixel signals, the timing controller may obtain the transformed transmission sequence based on the offset amount. The predetermined transforming relationship between the original transmission sequence and the transformed transmission sequence based on the offset amount "a" comprises the following methods but not limited thereto.

A), sequentially transferring the pixel signals from the first row to the $n_{th}$ row to the pixels in the first row to the $n_{th}$ row of the display, and when the pixel signals for each row are transferred, for the red sub-pixel signals, transferring the red sub-pixel signals for each column from the first column to the $m_{th}$ column to the red sub-pixels of pixels in the first column to the $m_{th}$ column of each row of the display, and for the green and blue sub-pixel signals, firstly transferring the original green and blue sub-pixel signals for each column from the $(a+1)_{th}$ column to the $m_{th}$ column to the green and blue sub-pixels of pixels in the first column to the $(m-a)_{th}$ column of each row of the display, then transferring the original green and blue sub-pixel signals for each column from the first column to the $a_{th}$ column to the green and blue sub-pixels of pixels in the $(m-a+1)_{th}$ column to the $m_{th}$ column of each row of the display, as shown in Table 3.

TABLE 3

| Transformed transmission sequence of the sub-pixel signals in each row based on the offset amount | | | | | | | | | | |
|---|---|---|---|---|---|---|---|---|---|---|
| 1R | 2R | 3R | . . . . . | (m − a)R | (m − a + 1)R | (m − a + 2)R | . . . . . | (m − 2)R | (m − 1)R | mR |
| (a + 1)G | (a + 2)G | (a + 3)G | . . . . . | mG | 1G | 2G | . . . . . | (a − 2)G | (a − 1)G | aG |
| (a + 1)B | (a + 2)B | (a + 3)B | . . . . . | mB | 1B | 2B | . . . . . | (a − 2)B | (a − 1)B | aB |

Also, the Table 3 corresponds to one row of pixels of the display, each column corresponds to one pixel of the display, and each unit corresponds to a sub-pixel of one color (e.g., red, green or blue). When the display works to display an image with the transformed transmission sequence of the 2D image sub-pixel signals, the red sub-pixels of the display form a red sub-image of the image, and the green sub-pixels and blue sub-pixels of the display form a cyan sub-image of the image; the red sub-image and the cyan sub-image offset from each other by "a" columns.

It should be understood that, in this disclosure, "sequential transferring" or the like expression is conducted with respect to the pixels in order (or pixel sequence) in one row of a display. For the transmission sequence for one row, the sub-pixel signal at the first place is transferred to one sub-pixel of the first pixel in the row, and so on. For example, in the above method, for the green sub-pixels, the green sub-pixel signal at the first place in the transformed transmission sequence is the green sub-pixel signal at the ath column in the original transmission sequence and is transferred to the green sub-pixel of the first pixel in one row, and so on.

B), sequentially transferring the pixel signals from the first row to the $n_{th}$ row, and when the pixel signals for each row are transferred, for the red sub-pixel signals, firstly transferring the red sub-pixel signals for each column from the first column to the $(m-a)_{th}$ column, then sequentially transferring arbitrary grey scale signals (NC) for "a" columns, and for the green and blue sub-pixel signals, firstly transferring the green and blue sub-pixel signals for each column from the $(a+1)_{th}$ column to the $m_{th}$ column, then sequentially transferring arbitrary grey scale signals (NC) for "a" columns, as shown in Table 4.

TABLE 4

| Transformed transmission sequence of the sub-pixel signals in each row based on the offset amount | | | | | | | | | | |
|---|---|---|---|---|---|---|---|---|---|---|
| 1R | 2R | 3R | . . . . . | (m − a)R | NC | NC | NC | . . . . . | NC | NC |
| (a + 1)G | (a + 2)G | (a + 3)G | . . . . . | mG | NC | NC | NC | . . . . . | NC | NC |
| (a + 1)B | (a + 2)B | (a + 3)B | . . . . . | mG | NC | NC | NC | . . . . . | NC | NC |

Also, the Table 4 corresponds to one row of pixels of the display, each column corresponds to one pixel of the display, and each unit corresponds to a sub-pixel of one color (e.g., red, green or blue). When the display works to display an image with the transformed transmission sequence of the 2D image sub-pixel signals, the red sub-pixels of the display form a red sub-image of the image, and the green sub-pixels and blue sub-pixels of the display form a cyan sub-image of the image; the red sub-image and the cyan sub-image offset from each other by "a" columns.

C), sequentially transferring the pixel signals from the first row to the $n_{th}$ row, and when the pixel signals for each row are transferred, for the red sub-pixel signals, firstly transferring the red sub-pixel signals for each column from the $(a+1)_{th}$ column to the $m_{th}$ column, then sequentially transferring arbitrary grey scale signals (NC) for "a" columns, and for the green and blue sub-pixel signals, firstly transferring the green and blue sub-pixel signals for each column from the first column to the $(m-a)_{th}$ column, then sequentially transferring arbitrary grey scale signals (NC) for "a" columns, as shown in Table 5.

TABLE 5

| Transformed transmission sequence of the sub-pixel signals in each row based on the offset amount | | | | | | | | | | |
|---|---|---|---|---|---|---|---|---|---|---|
| (a + 1)R | (a + 2)R | (a + 3)R | . . . . . | mR | NC | NC | NC | . . . . . | NC | NC |
| 1G | 2G | 3G | . . . . . | (m − a)G | NC | NC | NC | . . . . . | NC | NC |
| 1B | 2B | 3B | . . . . . | (m − a)B | NC | NC | NC | . . . . . | NC | NC |

Also, the Table 5 corresponds to one row of pixels of the display, each column corresponds to one pixel of the display, and each unit corresponds to a sub-pixel of one color (e.g., red, green or blue). When the display works to display an image with the transformed transmission sequence of the 2D image sub-pixel signals, the red sub-pixels of the display form a red sub-image of the image, and the green sub-pixels and blue sub-pixels of the display form a cyan sub-image of the image; the red sub-image and the cyan sub-image offset from each other by "a" columns.

Specifically, the transformed transmission sequence for the 2D image sub-pixel signals based on the offset amount may be obtained by the timing controller according to the modes as shown in Table 3, 4 and 5, but the embodiments of the disclosed technology are not limited thereto.

It can be seen from Tables 3, 4 and 5 that the original sub-pixel signal transmission sequence is changed when the stereoscopic displaying is conducted. As for most of the sub-pixels, the sub-pixel signals originally used for a same pixel (for displaying the same image point) are offset according to colors, then the sub-image displayed by the sub-pixels of different colors for the different eyes are offset by "a" pixel pitches. Thus, when the two sub-images of different colors enter into the left and right eyes of the viewer through different lenses, the stereoscopic effect can be realized. For example, as for Table 3, the original G and B sub-pixel signals at the $a_{th}$ column are transmitted into the G and B sub-pixels in the first column to be displayed, and the original R sub-pixel signal at the first column is still transmitted into the R sub-pixel at the first column, so that the sub-image displayed by the G and B sub-pixels and the sub-image displayed by the R sub-pixel are offset by a distance of "a" pixel columns.

Of course, it can be seen from Tables 3, 4 and 5 that, in several columns at the right side of the table, the offset column numbers for the sub-pixel signal for displaying the sub-images for different eyes does not correspond to the offset amount "a" or an arbitrary grey scale signal is used in these columns. These columns can not be used for effective stereoscopic displaying. However, since the offset amount "a" is small enough when compared with the column number for the whole screen, the whole stereo displaying effect is substantially not influenced.

Step 204, according to the above mentioned transformed transmission sequence, the timing controller outputs the 2D image sub-pixel signals so as to drive the above liquid crystal display to display a 3D image with stereoscopic effect before the viewer wearing a set of color filter glasses.

Therefore, in the embodiment, as for a viewer wearing a set of red/cyan glasses (one lens is a cyan one, which color is obtained by mixing blue and green colors, and the other lens is a red one), he/she can see the sub-image displayed by the green and blue sub-pixels through the red lens and see the corresponding sub-image displayed by the red sub-pixel through the cyan lens. Since the red sub-pixel signals are different from the green and blue sub-pixel signals in the transmission sequence compared with the original transmission sequences of these signals, the sub-image displayed by the red sub-pixels and the corresponding sub-image displayed by the green and blue sub-pixels have a certain visual parallax based on the offset amount "a," so that the viewer can see a 3D image with a stereoscopic effect.

In the embodiment, the offset amount is obtained by a timing controller based on the distance between the viewer and the liquid crystal display. Further, the transformed transmission sequence of the 2D image sub-pixel signals corresponding to the above offset amount is obtained. The timing controller outputs the sub-pixel signals of the 2D image according to the above transformed transmission sequence, thus the liquid crystal display can be driven to display a 3D image with a stereoscopic effect before the viewer wearing a set of color filter glasses. The method according to the embodiment of the disclosed technology can reduce the processing cost on the 2D image and enhance the flexibility for viewing.

FIG. 1 is a schematic view showing a structure of a liquid crystal display according to an embodiment of the disclosed technology. As shown in FIG. 1, the liquid crystal display of the embodiment comprises a driving circuit 31, a display screen 32 and a timing controller 33. The timing controller 33 is connected with the driving circuit 31 and can obtain a distance between the liquid crystal display and a viewer. An offset amount of the sub-pixels displaying the sub-images for different eyes is obtained, and a transformed transmission sequence of the 2D image sub-pixel signal corresponding to the above offset amount is obtained, so that the sub-pixels displaying the sub-images of different colors for different eyes can be offset based on the offset amount. According to the above transforming transmission sequence, the 2D image sub-pixel signals are output into the driving circuit 31 to drive the display screen 32 to display a 3D image with a stereoscopic effect before the viewer wearing a set of color filter glasses.

The liquid crystal display according to the embodiment can carry out the driving method of the liquid crystal display provided in one embodiment of the disclosed technology and comprise the corresponding functional modules.

In the embodiment, the offset amount is obtained by the timing controller based on the distance between the viewer and the liquid crystal display. Further, the transformed transmission sequence of the 2D image sub-pixel signals corresponding to the above offset amount is obtained. The timing controller outputs the sub-pixel signals of the 2D image according to the above transformed transmission sequence to the driving circuit, so as to drive the liquid crystal display to display a 3D image with a stereoscopic effect before the viewer wearing a set of color filter glasses. The method according to the embodiment of the disclosed technology can reduce the processing cost on the 2D image and enhance the flexibility for viewing.

Figure 2:
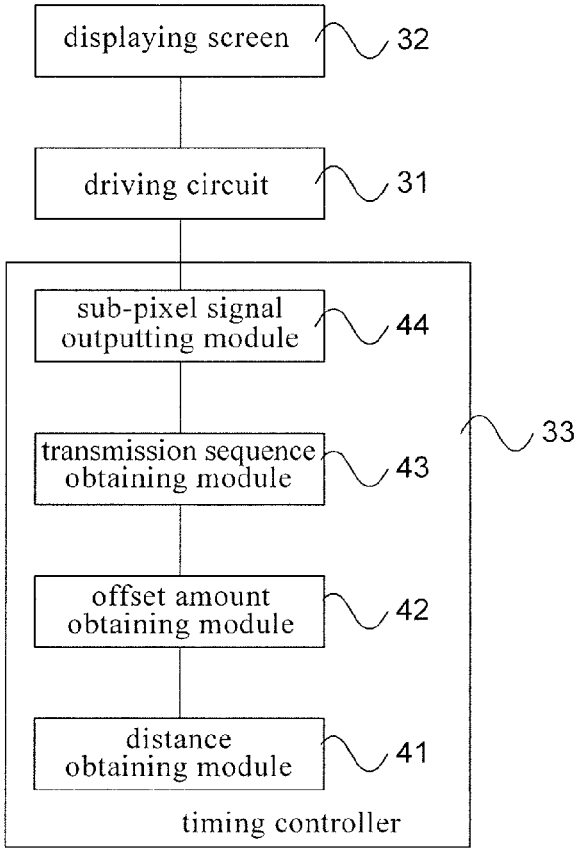
FIG. 2 is a schematic view showing a structure of a liquid crystal display according to another embodiment of the disclosed technology.

FIG. 2 is a schematic view showing a structure of a liquid crystal display according to another embodiment of the disclosed technology. As shown in FIG. 2, on the basis of the structure of the third embodiment, the timing controller 33 in the embodiment comprises a distance obtaining module 41, an offset amount obtaining module 42, a transmission sequence obtaining module 43 and a sub-pixel signal outputting module 44. The distance obtaining module 41 obtains the distance between the viewer and the liquid crystal display; the offset amount obtaining module 42 obtains an offset amount based on the distance obtained by the distance obtaining module 41; the transmission sequence obtaining module 43 obtains a transformed transmission sequence of the 2D image sub-pixel signals based on the offset amount obtained by the offset amount obtaining module 42; and the sub-pixel signal outputting module 44 outputs the 2D image sub-pixel signals according to the transformed transmission sequence obtained by the transferring obtaining module 43 to the driving circuit 31, so that the display screen is driven to display a 3D image with a stereoscopic effect before the viewer wearing a set of color filter glasses.

Further, the offset amount can be calculated by the timing controller with the following equation based on the distance obtained by the distance obtaining module 41:

$$a=[L*d/c],$$

where "a" is an offset amount and is an integer; the symbol "[ ]" means round function; "L" is a distance, "c" is a pixel pitch in a liquid crystal display; and "d" is ranging from 0.003~0.02.

The resolution of the liquid crystal display of the embodiment may be m*n, and "a" is less then "m." The transmission sequence obtaining module 43 in the embodiment can be used to obtain the original transmission sequence of the 2D image sub-pixel signals. The original transmission sequence of the 2D image sub-pixel signals is performed by sequentially transferring the pixel signals from the first row to the $n_{th}$ row, and when the pixel signals for each row are transferred, transferring the red sub-pixel signal (R), the green sub-pixel signal (G) and the blue sub-pixel signal (B) for each column from the first column to the $m_{th}$ column. Based on the above original transmission sequence of the 2D image sub-pixel signals, the transformed transmission sequence of the 2D image sub-pixel signals based on the offset amount is set or formed. The transformed transmission sequence of the 2D image sub-pixel signals based on the offset amount may be performed as follows by sequentially transferring the pixel signals from the first row to the $n_{th}$ row, and when the pixel signals for each row are transferred, for the red sub-pixel signals, transferring the red sub-pixel signals for each column from the first column to the $m_{th}$ column, and for the green and blue sub-pixel signals, firstly transferring the green and blue sub-pixel signals for each column from the $(a+1)_{th}$ column to the $m_{th}$ column, then transferring the green and blue sub-pixel signals for each column from the first column to the $a_{th}$, column.

Alternatively, the transmission sequence obtaining module 43 in the embodiment can be used to obtain the original transmission sequence of the 2D image sub-pixel signals. The original transmission sequence of the 2D image sub-pixel signals may be performed by sequentially transferring the pixel signal from the first row to the $n_{th}$ row, and when the pixel signals for each row are transferred, transferring the red sub-pixel signal (R), the green sub-pixel signal (G) and the blue sub-pixel signal (B) for each column from the first column to the $m_{th}$ column. Based on the above original transmission sequence of the 2D image sub-pixel signals, the transformed transmission sequence of the 2D image sub-pixel signals based on the offset amount is set or formed. The transformed transmission sequence of the 2D image sub-pixel signals based on the offset amount may be performed as follows by sequentially transferring the pixel signal from the first row to the $n_{th}$ row, and when the pixel signals for each row are transferred, for the red sub-pixel signals, firstly transferring the red sub-pixel signals for each column from the first column to the $(m-a)_{th}$ column, then sequentially transferring arbitrary grey scale signals (NC) for "a" columns, and for the green and blue sub-pixel signals, firstly transferring the green and blue sub-pixel signals for each column from the $(a+1)_{th}$ column to the $m_{th}$ column, then sequentially transferring arbitrary grey scale signals (NC) for "a" columns.

Alternatively, the transmission sequence obtaining module 43 in the embodiment can be used to obtain the original transmission sequence of the 2D image sub-pixel signals. The original transmission sequence of the 2D image sub-pixel signals may be performed by sequentially transferring the pixel signal from the first row to the $n_{th}$ row, and when transferring the pixel signals for each row, transferring the red sub-pixel signal (R), the green sub-pixel signal (G) and the blue sub-pixel signal (B) for each column from the first column to the $m_{th}$ column. Based on the above original transmission sequence of the 2D image sub-pixel signals, the transformed transmission sequence of the 2D image sub-pixel signals based on the offset amount is set or formed. The transformed transmission sequence of the 2D image sub-pixel signals based on the offset amount may be performed as follows by sequentially transferring the pixel signal from the first row to the $n_{th}$ row, and when the pixel signals for each row are transferred, for the red sub-pixel signals, firstly transferring the red sub-pixel signals for each column from the $(a+1)_{th}$ column to the $m_{th}$ column, then sequentially transferring arbitrary grey scale signals (NC) for "a" columns, and for the green and blue sub-pixel signals, firstly transferring the green and blue sub-pixel signals for each column from the first column to the $(m-a)_{th}$ column, then sequentially transferring arbitrary grey scale signals (NC) for "a" columns.

As for the method for transforming the transformed transmission sequence as above, each pixel in the screen should have the red, blue and green sub-pixels correspondingly.

It can be understood by those skilled in the art that the entire or a part of the method according to anyone of the above embodiments can be performed by hardware, software, or firmware with program. The program can be stored in a computer readable storage medium. When the above program is run, the steps in the above method embodiments can be performed. There are various kinds of storage media which can storage program codes, such as ROM, RAM, magnetic disk, optical disk and the like.

In addition, the stereoscopic display according to the embodiments of the disclosed technology is described by taken a liquid crystal display as an example. However, the driving method of stereoscopic display and the stereoscopic display according to the embodiments of the disclosed technology is not limited to the liquid crystal display, and can be applied into various kinds of displays, such as LED display or organic light-emitting display (OLED).

As for the above embodiment about the driving method of stereoscopic display and the stereoscopic display, it was described in an exemplified manner in the case that the red sub-pixels are used to display the red sub-image for one eye and the green and blue sub-pixels are used to display the corresponding cyan sub-image for the other eye. In this case, the viewer should wear a set of red/cyan glasses. However, it can be understood by those skilled in the art that the stereoscopic display and the driving method thereof should not limited to the above specific case. As long as the sub-images of different colors that are displayed by the sub-pixels of different colors respectively enter the left and right eyes of the viewer through lenses and the transmission sequence for the sub-pixel signals of two kinds (groups) of colors is transformed correspondingly similar to that of the red sub-pixels and the blue and green pixels in the mentioned embodiment, the similar stereoscopic displaying effect can be realized. At the same time, as for the stereoscopic display, each pixel of the screen should have the sub-pixels of colors, and the color filter glasses should be appropriately selected according to the two kinds (groups) of colors.

It should be noted that the above embodiments only have the purpose of illustrating the disclosed technology, but not limiting it. Although the disclosed technology has been described with reference to the above embodiment, those skilled in the art should understand that modifications or alternations can be made to the solution or the technical feature in the described embodiments without departing from the spirit and scope of the disclosed technology.

What is claimed is:

1. A driving method for a stereoscopic display, comprising:

obtaining a distance between a viewer and the stereoscopic display;

obtaining an offset amount for sub-pixels of different colors displaying the same image point for the different eyes based on the above distance;

obtaining a transformed transmission sequence of 2D image sub-pixel signals based on the offset amount, in which the sub-pixels of different colors for displaying the same image point for the different eyes are offset by the offset amount on the stereoscopic display; and outputting the 2D image sub-pixel signals according to the transformed transmission sequence so as to display sub-images of different colors for the different eyes, wherein obtaining the distance comprises: calculating the offset amount by the following equation based on the distance: a =[L*d/c], the "a" is an offset amount and is an integer; the symbol "[]" means round function; the "L" is a distance, the "c" is a pixel pitch in the stereoscopic display; and the "d" is ranging from 0.003~0.02, wherein the sub-pixels of different colors used for displaying the sub-images of different colors for the different eyes comprise first color sub-pixels and second color sub-pixels, and wherein the resolution of the stereoscopic display is m*n, and "a" is less than "m", wherein "m" and "n" are positive integers, and the method further comprising: obtaining an original transmission sequence of the 2D image sub-pixel signals, and the original transmission sequence of the 2D image sub-pixel signals is performed as follows by sequentially transferring the pixel signal from the first row to the $n_{th}$ row and when the pixel signals for each row are transferred, transferring the first color sub-pixel signals, the second color sub-pixel signals for each column from the first column to the $m_{th}$ column.

2. The method of Claim 1, wherein the "d" is 0.01.

3. The method of claim 1, wherein the first color sub-pixels comprises red sub-pixels, and the second color sub-pixels comprises green sub-pixels and blue sub-pixels.

4. The method of claim 1, further comprising:

obtaining the transformed transmission sequence of the 2D image sub-pixel signals based on the offset amount and the original transmission sequence of the 2d image sub-pixel signals, the transformed transmission sequence of the 2D image sub-pixel signals is performed as follows by sequentially transferring the pixel signals from the first row to the $n_{th}$ row, and when the pixel signals for each row are transferred, for the first color sub-pixel signals, transferring the first color sub-pixel signals for each column from the first column to the $m_{th}$ column, and for the second color sub-pixel signals, firstly transferring the second color sub-pixel signals for each column from the $(a+l)_{th}$ column to the $m_{th}$ column, then transferring the second color sub-pixel signals for each column from the first column to the remaining $a_{th}$ column.

5. The method of claim 1, further comprising:

obtaining the transformed transmission sequence of the 2D image sub-pixel signals based on the offset amount and the original transmission sequence of the 2d image sub-pixel signals, the transformed transmission sequence of the 2D image sub-pixel signals is performed as follows by sequentially transferring the pixel signals from the first row to the $n_{th}$ row, and when the pixel signals for each row are transferred, for the first color sub-pixel signals, firstly transferring the first color sub-pixel signals for each column from the first column to the $(m-a)_{th}$ column, then sequentially transferring arbitrary grey scale signals (NC) for the remaining "a" columns, and for the second color sub-pixel signals, firstly transferring the second color sub-pixel signals for each column from the $(a+l)_{th}$ column to the $m_{th}$ column, then sequentially transferring arbitrary grey scale signals (NC) for the remaining "a" columns.

6. The method of claim 1, further comprising:

obtaining the transformed transmission sequence of the 2D image sub-pixel signals based on the offset amount and the original transmission sequence of the 2d image sub-pixel signals, the transformed transmission sequence of the 2D image sub-pixel signals is performed as follows by sequentially transferring the pixel signals from the first row to the $n_{th}$ row, and when the pixel signals for each row are transferred, for the first color sub-pixel signals, firstly transferring the first color sub-pixel signals for each column from the $(a+1)_{th}$ column to the $m_{th}$ column, then sequentially transferring arbitrary grey scale signals (NC) for the remaining "a" columns, and for the second color sub-pixel signals, firstly transferring the second color sub-pixel signals for each column from the first column to the $(m-a)_{th}$ column, then sequentially transferring arbitrary grey scale signals (NC) for the remaining "a" columns.

7. A stereoscopic display comprising:

a driving circuit;

a display screen; and a timing controller, connected with the driving circuit, and adapted to obtain a distance between the stereoscopic display and a viewer, an offset amount of the sub-pixels of different colors for displaying an image point for the different eyes based on the distance, and then a transformed transmission sequence of the 2D image sub-pixel signal corresponding to the above offset amount, so that the sub-pixels of different colors displaying the image point for the different eyes are offset by the offset amount on the display screen, and to output the 2D image sub-pixel signals according to the transformed transmission sequence into the driving circuit to display the sub-images of different colors for the different eyes, wherein the offset amount obtaining module calculates the offset amount with the following equation: a [L*d/c], the "a" is an offset amount and is an integer; the symbol "[]" means round function; the "L" is a distance, the "c" is a pixel pitch in the stereoscopic display; and the "d" is ranging from 0.003~0.02, wherein the display screen comprises first color sub-pixels and second color sub-pixels to display sub-images of different colors for the different eyes, and wherein the resolution of the stereoscopic display is m*n, wherein "m" and "n" are positive integers, and "a" is less than "m", the transmission sequence obtaining module obtain the transformed transmission sequence of the 2D image sub-pixel signals based on the offset amount comprises: obtaining an original transmission sequence of the 2D image sub-pixel signals, and the original transmission sequence of the 2D image sub-pixel signals being performed as follows by: sequentially transferring the pixel signals from the first row to the $n_{th}$ row, and when the pixel signals for each row are transferred, transferring the first color sub-pixel signals, the second color sub-pixel signals for each column from the first column to the $m_{th}$ column.

8. The stereoscopic display of claim 7, wherein the timing controller comprises:

a distance obtaining module, operative to obtain the distance between the viewer and the stereoscopic display;

an offset amount obtaining module, operative to obtain an offset amount based on the distance, a transmission sequence obtaining module, operative to obtain a transformed transmission sequence of the 2D image sub-pixel signals based on the offset amount;

and a sub-pixel signal outputting module, operative to output the 2D image sub-pixel signals to the driving circuit according to the transformed transmission sequence.

9. The stereoscopic display of claim 7, wherein the first color sub-pixels comprise red sub-pixels, and the second color sub-pixels comprise green sub-pixels and blue sub-pixels.

10. The stereoscopic display of claim 7, wherein the transmission sequence obtaining module obtain the transformed transmission sequence of the 2D image sub-pixel signals based on the offset amount comprises:

obtaining the transformed transmission sequence of the 2D image sub-pixel signals based on the offset amount and the original transmission sequence of the 2d image sub-pixel signals, the transformed transmission sequence of the 2D image sub-pixel signals being performed as follows by: sequentially transferring the pixel signals from the first row to the $n_{th}$ row, and when the pixel signals for each row are transferred, for the first color sub-pixel signals, transferring the first color sub-pixel signals for each column from the first column to the $m_{th}$ column, and for the second color sub-pixel signals, firstly transferring the second color sub-pixel signals for each column from the $(a+1)_{th}$ column to the $m_{th}$ column, then transferring the second color sub-pixel signals for each column from the first column to the remaining $a_{th}$ column.

11. The stereoscopic display of claim 7, wherein the transmission sequence obtaining module obtain the transformed transmission sequence of the 2D image sub-pixel signals based on the offset amount comprises:

obtaining the transformed transmission sequence of the 2D image sub-pixel signals based on the offset amount and the original transmission sequence of the 2d image sub-pixel signals, the transformed transmission sequence of the 2D image sub-pixel signals being performed as follows by: sequentially transferring the pixel signals from the first row to the $n_{th}$ row, and when the pixel signals for each row are transferred, for the first color sub-pixel signals, firstly transferring the first color sub-pixel signals for each column from the first column to the $(m-a)_{th}$ column, then sequentially transferring arbitrary grey scale signals (NC) for "a" columns, and for the second color sub-pixel signals, firstly transferring the second color sub-pixel signals for each column from the $(a+1)_{th}$ column to the $m_{th}$ column, then sequentially transferring arbitrary grey scale signals (NC) for the remaining "a" columns.

12. The stereoscopic display of claim 7, wherein the transmission sequence obtaining module obtain the transformed transmission sequence of the 2D image sub-pixel signals based on the offset amount comprises:

obtaining the transformed transmission sequence of the 2D image sub-pixel signals based on the offset amount and the original transmission sequence of the 2d image sub-pixel signals, the transformed transmission sequence of the 2D image sub-pixel signals being performed as follows by: sequentially transferring the pixel signal from the first row to the $n_{th}$ row; when the pixel signals for each row are transferred, for the first color sub-pixel signals, firstly transferring the first color sub-pixel signals for each column from the $(a+1)_{th}$ column to the $m_{th}$ column, then sequentially transferring arbitrary grey scale signals (NC) for "a" columns, and for the second color sub-pixel signals, firstly transferring the second color sub-pixel signals for each column from the first column to the $(m-a)_{th}$ column, then sequentially transferring arbitrary grey scale signals (NC) for the remaining "a" columns.

13. A driving method for a stereoscopic display, comprising:

obtaining a distance between a viewer and the stereoscopic display;

obtaining an offset amount for sub-images of different colors displaying the same image for the different eyes based on the above distance;

obtaining a transformed transmission sequence of 2D image sub-pixel signals based on the offset amount, in which the sub-images of different colors for the different eyes are offset by the offset amount on the stereoscopic display; and outputting the 2D image sub-pixel signals according to the transformed transmission sequence so as to display sub-images of different colors for the different eyes wherein obtaining the distance comprises: calculating the offset amount by the following equation based on the distance: a [L*d/c], the "a" is an offset amount and is an integer; the symbol "[]" means round function; the "L" is a distance, the "c" is a pixel pitch in the stereoscopic display; and the "d" is ranging from 0.003~0.02, wherein the sub-images of different colors for the different eyes comprise a first color sub-image and a second color sub-image, and wherein "m" and "n" are positive integers, and the method further comprising: obtaining an original transmission sequence of the 2D image sub-pixel signals, and the original transmission sequence of the 2D image sub-pixel signals is performed as follows by sequentially transferring the pixel signal from the first row to the $n_{th}$ row and when the pixel signals for each row are transferred, transferring the sub-pixel signals of the first color sub-image, the sub-pixel signals of the second color sub-image for each column from the first column to the $m_{th}$ column.

* * * * *